United States Patent [19]

Haglund et al.

[11] 4,066,035

[45] Jan. 3, 1978

[54] APPARATUS FOR MOUNTING AND DISMOUNTING A SUBMERGED PROPELLER UNIT FOR A FLOATING BODY

[75] Inventors: Kjell Haglund, Karlstad; Hakan Hasse Carlsson, Kristinehamn, both of Sweden

[73] Assignee: Aktiebolaget Karlstads Mekaniska Werkstad, Karlstad, Sweden

[21] Appl. No.: 691,840

[22] Filed: June 1, 1976

[30] Foreign Application Priority Data

June 6, 1975 Sweden ..... 7506471

[51] Int. Cl.[2] ..... B63H 5/06

[52] U.S. Cl. ..... 115/34 R; 294/81 R

[58] Field of Search ..... 114/.5 D, .5 R, 77 A, 114/179, 269, 265; 294/81 R, 78 A; 61/69 R; 115/41 R, .5 B, 35, 72, 34 R

[56] References Cited

U.S. PATENT DOCUMENTS

| | | | |
|---|---|---|---|
| 819,576 | 5/1906 | McCabe | 294/81 R |
| 2,987,027 | 6/1961 | Wanzer | 115/41 R |
| 3,401,804 | 9/1968 | Link | 294/81 R |
| 3,433,459 | 3/1969 | Logan | 294/81 R X |
| 3,934,528 | 1/1976 | Horton et al. | 114/.5 D |

*Primary Examiner*—George E. A. Halvosa
*Assistant Examiner*—Gregory W. O'Connor

[57] ABSTRACT

Apparatus for mounting and dismounting a submerged propeller unit to and from the hull of a floating body from the outside thereof comprises a flange in the hull surrounding an opening therein and having passages therein, a flange on the propeller unit having fasteners at locations corresponding to the locations of the passages in the hull flange, a drive coupling member on the propeller unit, a plurality of guides on the propeller unit for guiding the coupling member into the hull opening and for positioning the propeller unit flange in proper relation to the hull flange as the propeller unit is raised into position, a lifting yoke carrying a plurality of lifting cables extending through watertight ways in the hull and adapted to be secured detachably to the propeller unit whereby the propeller unit flange may be raised to the level of the hull flange with the fasteners in the former in registry with the passages in the latter to facilitate securing the propeller unit flange to the hull flange.

2 Claims, 5 Drawing Figures

FIG. 2
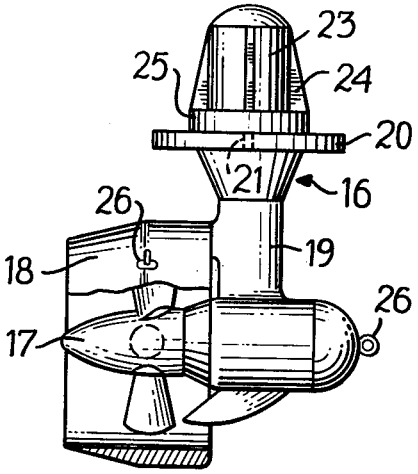
FIG. 3
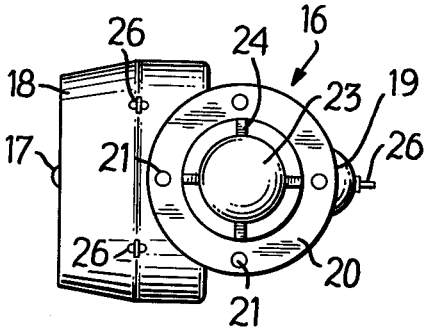
FIG. 4
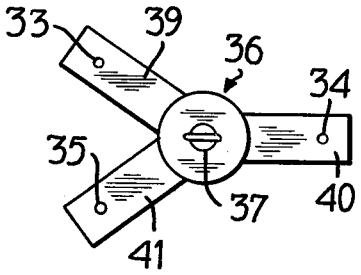
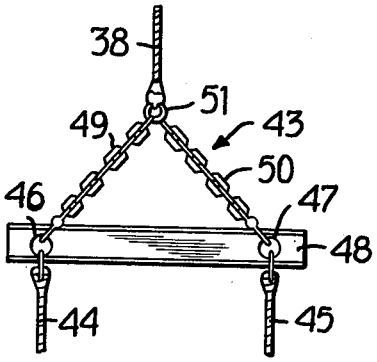
FIG. 5

APPARATUS FOR MOUNTING AND DISMOUNTING A SUBMERGED PROPELLER UNIT FOR A FLOATING BODY

BACKGROUND OF THE INVENTION

This invention relates to apparatus for mounting and dismounting a submerged propeller unit to and from the hull of a floating body from the outside thereof. More particularly, it relates to new and improved apparatus of this character which is of particular utility in connection with turnable steering propellers mounted on vertical driving shafts, so-called thrusters, which are used with deeply submerged floating bodies of the type that support oil drilling rigs.

Apparatus has been proposed heretofore for mounting and dismounting a propeller unit with a vertical drive shaft at the bottom of a vessel without docking the vessel. In one such arrangement (shown in Swedish Pat. No. 181,061), the work of mounting or dismounting the propeller unit takes place in a chamber or barrel in the vessel which has an open upper end located above the waterline of the vessel and a lower end secured in watertight relation to the bottom of the vessel and surrounding an opening therein. In practice, the propeller unit is lowered into position through the barrel and fastened by flanges forming a closure for the opening in the vessel bottom. Alternatively, the propeller unit may be raised into position from the outside of the vessel and thereafter secured to the hull by bolts inserted from inside the barrel.

Outside mounting has many advantages, especially for large vessels, since it eliminates the necessity for transporting the propeller unit within the vessel. The open barrel technique requires so much space, however, that it is not practical. In some cases, it is possible to pressurize the space in which the mounting or dismounting work is to be done so as to keep the water out of it. Working in a pressurized space, however, introduces further difficulties that make this technique unattractive.

The copending application Ser. No. 691,838 filed June 1, 1976, by Anders Lennart Pehrsson (Docket No. 22845) discloses novel and highly effective apparatus of this general character in which a removable, watertight housing is secured over the flanged opening in the hull in which the propeller unit is to be received, the propeller unit is positioned in the water outside the body and raised to bring a flange thereon in registry with the flange around the opening in the hull, and the two flanges are secured together in watertight relation by fastenings put in place by tools located within the watertight housing that are operable from a location outside of the housing.

SUMMARY OF THE INVENTION

The present invention relates to new and improved apparatus for raising a propeller unit into position outside the body on which it is to be mounted in such fashion that the propeller unit flange is brought to the level of the hull flange with fastening components in the former and in the latter in substantial registry and with a substantially even contact pressure between the flanges.

This is accomplished, according to the invention, by providing a lifting yoke carrying a plurality of cables extending through watertight ways formed in the hull and adapted to be secured detachably to the propeller unit. Also, the propeller unit is provided with guide means adapted to cooperate with the flange surrounding the opening in the hull as the unit is raised into position to facilitate the entry of the propeller unit coupling member into the opening. The hull ways are so located that as the propeller unit is lifted by the cables it will eventually be positioned with its drive coupling in the hull opening and with cooperating fastening means on the unit and on the hull in substantial registry as required to enable the two flanges to be secured together.

For a better understnding of the invention, reference is made to the following detailed description of a preferred embodiment, taken in conjunction with the accompanying drawings, in which:

FIG. 2 is a side view of the propeller unit shown in FIG. 1;

FIG. 3 is a top view of the propeller unit shown in FIG. 2;

FIG. 4 is a top view of a cable supporting yoke used in the apparatus of FIG. 1; and FIG. 5 is a side view of a modified form of lifting yoke for use with the apparatus of FIG. 1.

Figure 1:
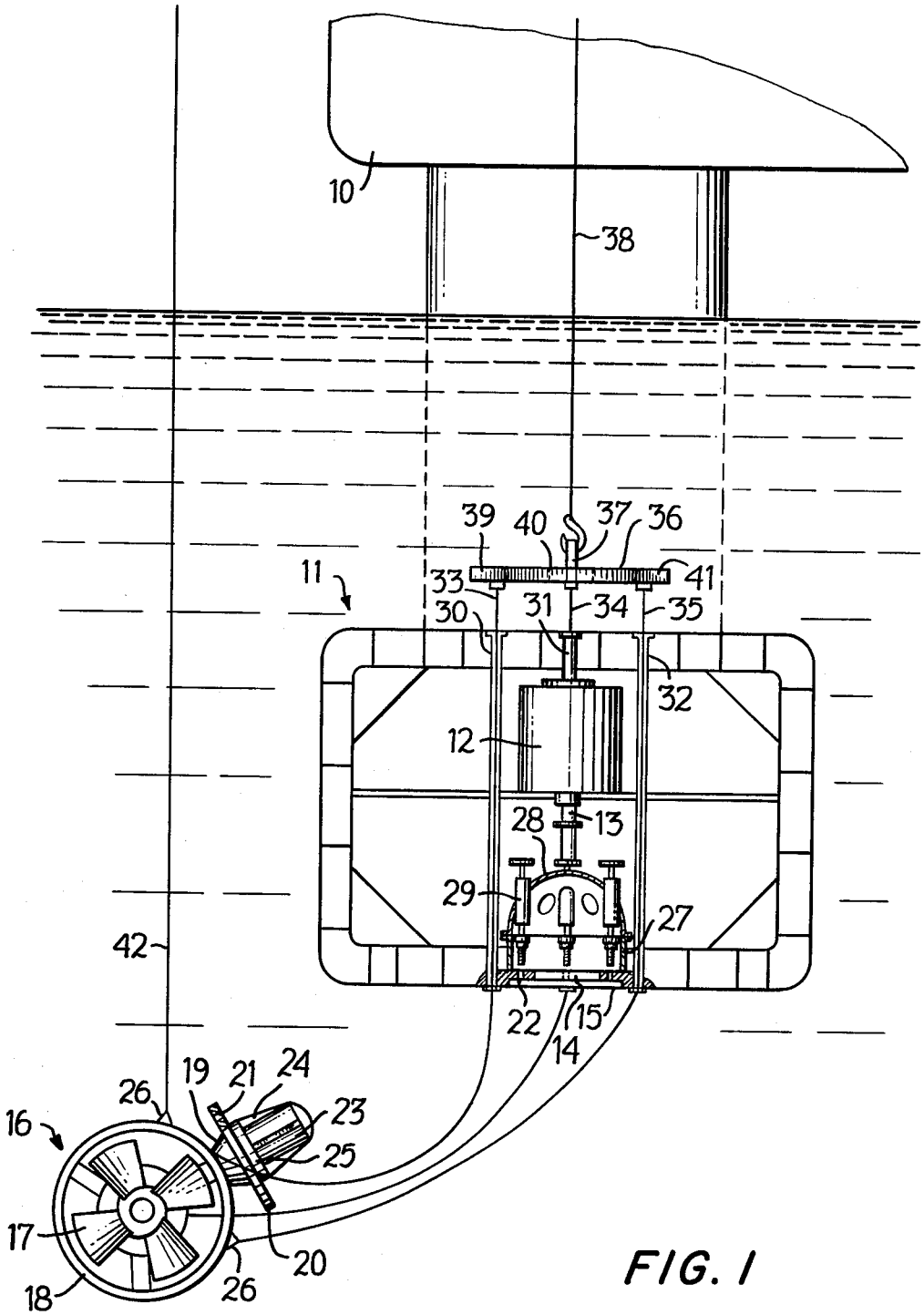
FIG. 1 is a view, partly in vertical section, of apparatus constructed according to the invention for lifting a propeller unit to the level of an opening in the hull of a floating body.

Referring first to FIG. 1, there is shown part of an oil drilling rig 10 supported by a plurality of propeller driven floating bodies 11, such as pontoons, for example, (only one being visible in the figure) submerged deep below the water surface. Each floating body 11 is provied with propulsion machinery 12 having a vertical drive shaft 13. The body 11 has an opening 14 formed therein surrounded by a flange 15 on which a propeller unit 16 is adpated to be mounted. The propeller unit 16 comprises a propeller 17 having a horizontal shaft and a propeller nozzle 18 both carried by a propeller housing 19. The housing 19 is fomred with a flange 20 provided with threaded holes 21 for connection by fastening means such as bolts 22 (FIG. 1), for example, to the flange 15 in the bottom of the floating body 11.

The flange 20 of the propeller unit 16 is equipped with a coupling member 23 having tapered guiding edges 24 diverging to a short cylindrical portion 25 just above the flange 20. The diameter of the cylindrical portion 25 is slightly less than the diameter of the opening 14 in the body so as to be snugly received therein. Enclosed within the coupling member 23 is means (not shown) for connecting the propeller unit 16 to the vertical drive shaft 13 of the propulsion machinery 12 after the propeller unit 16 has been mounted on the body 11.

The propeller nozzle 18 and the propeller housing 19 are provided with lifting means such as eyebolts 26. As shown in FIGS. 2 and 3, the eyebolts 26 are preferably located at the corners of a triangle within which the propeller unit 16 has its center of gravity when subsmerged in water.

The hull flange 15 (FIG. 1) is formed with a short cylindrical portion 27 extending into the floating body 11 to which a sealing dome 28 is adapted to be detachably secured when the propeller unit is to be mounted or dismounted. The sealing dome 28 is provided with a plurality of tools 29 for retaining and screwing or unscrewing the bolts 22 in propeller unit mounting and dismounting operations as more fully described in the aforementioned Pehrssohn application Ser. No. 691,838.

For raising or lowering a propeller unit in a mounting or dismounting operation, the floating body 11 is provided with three watertight tubular ways 30, 31 and 32, open at both ends and extending completely through the hull of the floating body, through which pass the cables 33, 34 and 35. The upper ends of the cables 33, 34 and 35 are attached to a lifting yoke 36 and the lower ends are provided with means such as hooks for connection to the eyebolts 26 on the propeller unit 16. The lifting yoke 36 has an eyebolt 37 for connection by a cable 38 to a crane or other suitable lifting device (not shown) mounted on the oil drilling rig 10.

As best shown in FIG. 4, the lifting yoke 36 comprises angularly spaced apart arms 39, 40 and 41 to which the upper ends of the cables 33, 34 and 35 are secured, respectively. Both the points of attachment of the cables to the arms of the lifting yoke 36 and the locations of the tubular ways 30, 31 and 32 are in correspondance with the locations of the eyebolts 26 on the propeller unit 16 so that when the latter is hanging at its correct mounting position the runs of the cables 33, 34 and 35 through the tubular ways 30, 31 and 32 are straight and substantially vertical throughout their whole lengths.

In preparation for mounting a propeller on the floating body 11, the sealing dome 28 (FIG. 1) is secured to the cylindrical portion 27 above the hull flange 15 and the tools 29 are fitted with bolts as described in the aforementioned Pehrsson application Ser. No. 691,838. The propeller unit 16 is then suspended on a cable 42 carried by a crane (not shown) on the oil drilling rig 10 and is lowered to a level near the bottom of the floating body 11 as shown in FIG. 1.

The lifting yoke 36 carrying the cables 33, 34 and 35 is then suspended on the cable 38 carried by another crane (not shown), also located on the drilling rig 10, and the cables 33, 34 and 35 are lowered through the tubular ways 30, 31 and 32, respectively, and attached to the eyebolts 26 of the propeller unit 16 by divers. The propeller unit 16 is then lowered further on the cable 42 unit it is supported only by the three cables 33, 34 and 35, at which time the cable 42 is removed.

The cable 38 is then hoisted up to bring the propeller unit 16 to a position where the propeller flange 20 faces the hull flange 15. As the propeller unit 16 continues to move upwardly, the coupling member 23 enters the opening 14 in the hull and the guiding edges 24 cooperate with the wall of the opening 14 to guide the propeller unit 16 to a position in which the threaded holes 21 in the propeller flange 20 are directly below the bolts 22 in the tools 29.

If the surfaces of the two flanges 20 and 15 are not parallel when contact is first made, they will meet in a point around which the propeller unit 16 will turn as the hoisting is continued. The lifting yoke 36 will thereby turn slightly around its eyebolt 37 and thus enable the propeller unit 16 to be hoisted until the flanges 20 and 15 are in complete contact with each other and the pressure is evenly distributed.

The bolts 22 are then screwed through the openings in the hull flange 15 into the threaded openings 21 in the propeller flange 20, the tools 29 are disengaged from the bolts, and the sealing dome 28 is drained and removed, all as described in the copending Pehrsson application Ser. No. 691,838. The cables 33, 34 and 35 are then unhooked from the eyebolts 26 on the propeller unit 16 and the lifting yoke 36 with the cables attached thereto is brought up to the oil drilling rig 10 by the cable 38. The propeller unit 16 may then be connected to the vertical drive shaft 13 of the propulsion machinery 12 in the floating body 11 in the known manner.

For smaller propeller units having a symmetrical weight distribution, a simpler lifting yoke 43 of the type shown in FIG. 5 may be used. The yoke 43 utilizes only two supporting cables 44 and 45, extending through the tubular ways 30 and 32, respectively, and secured at their upper ends to openings 46 and 47 formed in spaced apart relation in a beam 48. The beam 48 may be connected to the cable 38 by two chains 49 and 50 secured at their lower ends to the openings 46 and 47 in the beam 48 and at their upper ends to a ring 51 coupled to the lower end of the cable 38. The chains 49 and 50 should be of sufficient length to permit the beam 48 to lie substantially horizontal when the propeller unit is hanging free on the supporting cables 44 and 45 with its flange also substantially horizontal.

The specific embodiments described above are intended to be merely illustrative and may be modified in form and detail within the scope of the following claims, as will be apparent to those skilled in the art.

We claim:

1. Apparatus for lifting a propeller unit having a mounting flange and a plurality of lifting elements spaced about said mounting flange from a position away from and beneath a floating body to an assembly position where the mounting flange is adjacent and in proper relation for assembly to a flange defining an opening in the bottom of the body, or for lowering it away from said assembly position, wherein the improvement comprises-means forming a plurality of passageways extending downwardly through the body from inlet ports in the top of the body to outlet ports in the bottom of the body and spaced about said opening therein, a plurality of cables threaded through said respective passageways and extending below said outlet ports, a yoke supporting above the body, means connecting the upper ends of said cables to said yoke, and means at the lower end of each cable for coupling the cable to one of said propeller unit lifting elements, respectively, said passageways and said means connecting the cables to said yoke being disposed in correspondence with the spatial arrangement of said propeller unit lifting elements, whereby said propeller unit can be brought into proper position for assembly to the bottom of said floating body by raising said yoke.

2. Apparatus as defined as claim 1 in which the cables are of equal length, the points of attachment of the cables to the yoke lie in a substantially horizontal plane and are at the corners of a first triangle, the lifting elements on the propeller unit when suspended by the cables lie at a substantially horizontal plane and are at the corners of a second triangle coincident with the first triangle and the intersections of said passageways with a transverse plane therethrough lie at the corners of a third triangle substantially coincident with said first and second triangles.

* * * * *